US007392589B2

(12) United States Patent
Friegang

(10) Patent No.: US 7,392,589 B2
(45) Date of Patent: Jul. 1, 2008

(54) APPARATUS AND METHOD FOR SCRIBING TRIM STRIPS

(76) Inventor: William Robert Friegang, 5025 Vanderbilt Dr., San Jose, CA (US) 95130

( * ) Notice: Subject to any disclaimer, the term of this patent is extended or adjusted under 35 U.S.C. 154(b) by 0 days.

(21) Appl. No.: 11/458,801

(22) Filed: Jul. 20, 2006

(65) Prior Publication Data

US 2007/0033886 A1 Feb. 15, 2007

Related U.S. Application Data

(60) Provisional application No. 60/701,352, filed on Jul. 21, 2005.

(51) Int. Cl.
*B25H 7/00* (2006.01)
*B43L 13/02* (2006.01)

(52) U.S. Cl. ..... 33/42; 33/41.6; 33/526

(58) Field of Classification Search ..... 33/41.1, 33/41.3, 41.5, 41.6, 42, 194, 501, 526, 573; 269/1, 2, 41, 43, 97, 231, 900, 904; 52/127.5; 248/229.1, 229.11, 229.15, 229.2, 229.21, 248/229.25

See application file for complete search history.

(56) References Cited

U.S. PATENT DOCUMENTS 1,159,979 A * 11/1915 Moore ..... 33/41.6
1,255,773 A * 2/1918 Morse ..... 269/166
1,297,539 A * 3/1919 Bull ..... 269/221
1,319,900 A * 10/1919 Reeder ..... 269/45
1,781,997 A * 11/1930 Berezowski ..... 269/41
1,987,826 A * 1/1935 Heumann ..... 403/73
2,509,876 A * 5/1950 Neiss ..... 33/41.5
2,636,527 A * 4/1953 Schiemann ..... 269/45
2,786,274 A * 3/1957 Early ..... 33/41.5
3,516,167 A * 6/1970 McCain, Jr. ..... 33/41.6
3,583,694 A * 6/1971 Davies ..... 269/98
3,854,712 A * 12/1974 McGee ..... 269/43
3,914,871 A * 10/1975 Wolff ..... 408/103
4,141,542 A * 2/1979 Wolff ..... 269/88
4,227,307 A * 10/1980 Tassoni ..... 33/41.6
4,607,829 A * 8/1986 Suska ..... 269/88
4,795,141 A * 1/1989 Mulvaney ..... 269/41
5,013,196 A 5/1991 Friegang
5,815,931 A * 10/1998 Cleveland ..... 30/373
5,862,601 A * 1/1999 O'Brien et al. ..... 33/42
2004/0055168 A1 * 3/2004 Allen ..... 33/42

* cited by examiner

*Primary Examiner*—R. A. Smith
(74) *Attorney, Agent, or Firm*—Edward S. Wright

(57) ABSTRACT

Apparatus and method for scribing a trim strip to fit between a cabinet and a nearby surface with a first edge of the trim strip facing one side of the cabinet and a second edge of the trim strip facing the surface in which a guide is run along the surface, a scribing tool spaced a predetermined distance from the guide transfers the contour of the surface to the trim strip as the guide is run along the surface, and the trim strip is held in a fixed position with the first edge of the trim strip offset from the side of the cabinet by the predetermined distance as the contour of the surface is transferred to the trim strip.

11 Claims, 4 Drawing Sheets

APPARATUS AND METHOD FOR SCRIBING TRIM STRIPS

RELATED APPLICATIONS

Provisional Application No. 60/701,352, filed Jul. 21, 2005, the priority of which is claimed.

BACKGROUND OF THE INVENTION

1. Field of Invention

This invention pertains generally to tools for use in the installation of cabinets and, more particularly, to apparatus and a method for scribing a trim strip to fit between a cabinet and a nearby wall or ceiling.

2. Related Art

When installing frameless cabinets, spaces are left between the cabinets and nearby walls and/or ceilings to allow for variations in the surfaces of the walls or ceilings. After the cabinets have been installed, the spaces are filled with trim strips, commonly known as scribe strips, which have been trimmed or cut to conform to the contours of the surfaces of the walls and/or ceilings.

The fitting of a scribe strip was traditionally done by transferring the contour of the wall or ceiling to the scribe strip with a carpenter's scribe or other marking tool and then cutting the scribe strip to mate with that contour with a tool such as a saw or a plane or, more recently, with a router.

U.S. Pat. No. 5,013,196 discloses a scribing accessory for an offset router which has a guide wheel disposed concentrically of the router bit for engagement with a surface to facilitate the trimming of a laminate or other material to mate with the surface. This tool is marketed under the trademark Quickscribe.

OBJECTS AND SUMMARY OF THE INVENTION

It is in general an object of the invention to provide a new and improved holding tool and method for scribing a trim strip to fit between a cabinet and a nearby wall or ceiling.

Another object of the invention is to provide a holding tool and method of the above character which overcome the limitations and disadvantages of techniques heretofore employed in the installation of scribe strips.

These and other objects are achieved in accordance with the invention by providing apparatus and a method for scribing a trim strip to fit between a cabinet and a nearby surface with a first edge of the trim strip facing one side of the cabinet and a second edge of the trim strip facing the surface in which a guide is run along the surface, a scribing tool spaced a predetermined distance from the guide transfers the contour of the surface to the trim strip as the guide is run along the surface, and the trim strip is held in a fixed position with the first edge of the trim strip offset from the side of the cabinet by the predetermined distance as the contour of the surface is transferred to the trim strip.

DETAILED DESCRIPTION

Figure 1:
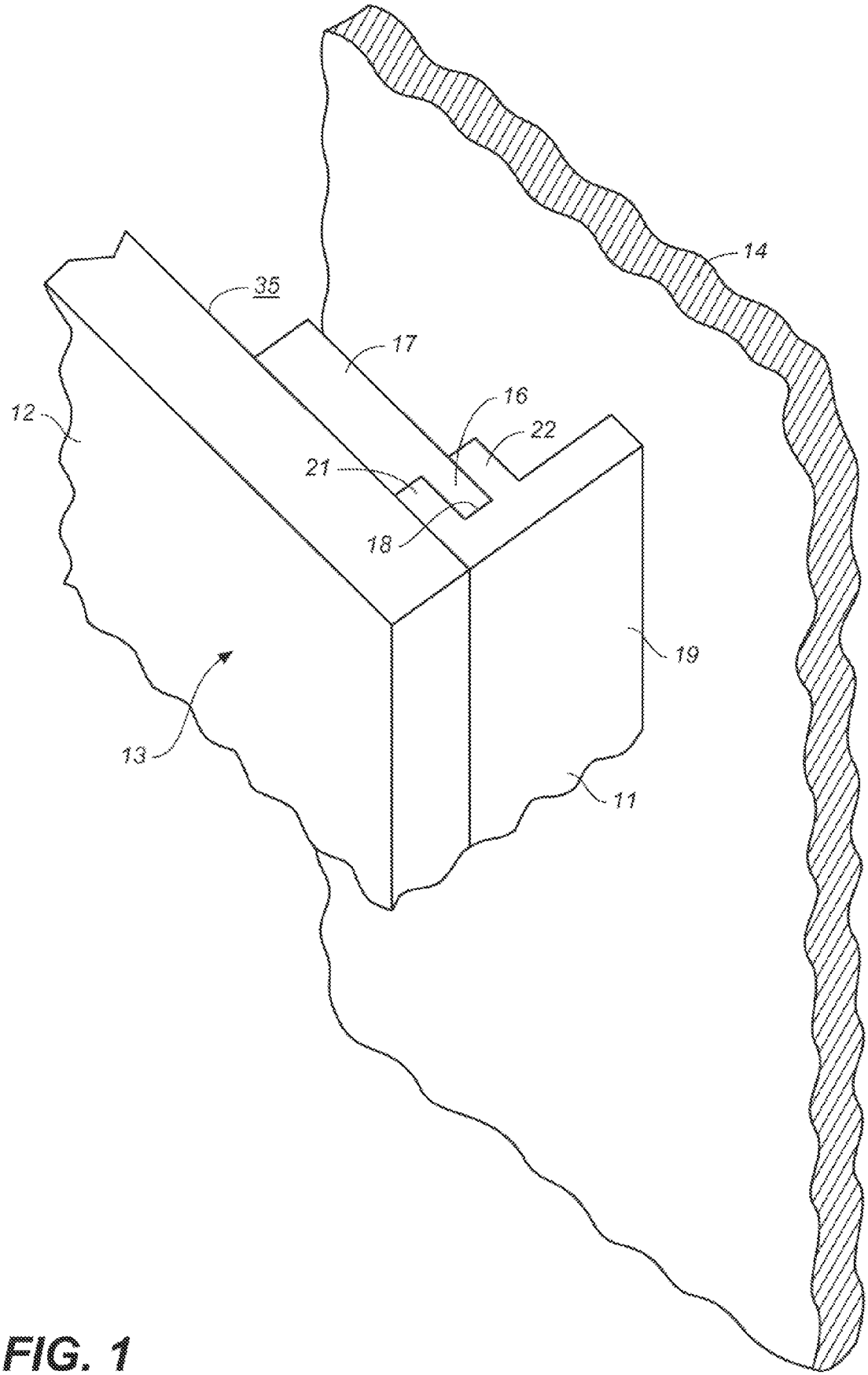
FIG. 1 is a fragmentary isometric view of a trim strip which has been scribed or trimmed to fit between the outer wall of a cabinet and a nearby wall or ceiling.

FIG. 1 illustrates a trim strip 11 filling a space between the outer wall 12 of a frameless cabinet 13 and a nearby wall or ceiling 14. The trim strip is held in place by frictional engagement with a forwardly facing tongue 16 on a cleat 17 affixed to the outer wall of the cabinet. The trim strip has a rearwardly facing groove 18 in which the tongue is received, and the outer rear portion of the trim strip is cut away, leaving a strip 19 of reduced thickness which is easier to cut to match the contour of the surface of the wall or ceiling. The trim strip thus has a cross-sectional shape resembling the letter "F", with rearwardly projecting ribs 21, 22 on opposite sides of groove 18.

Figure 2:
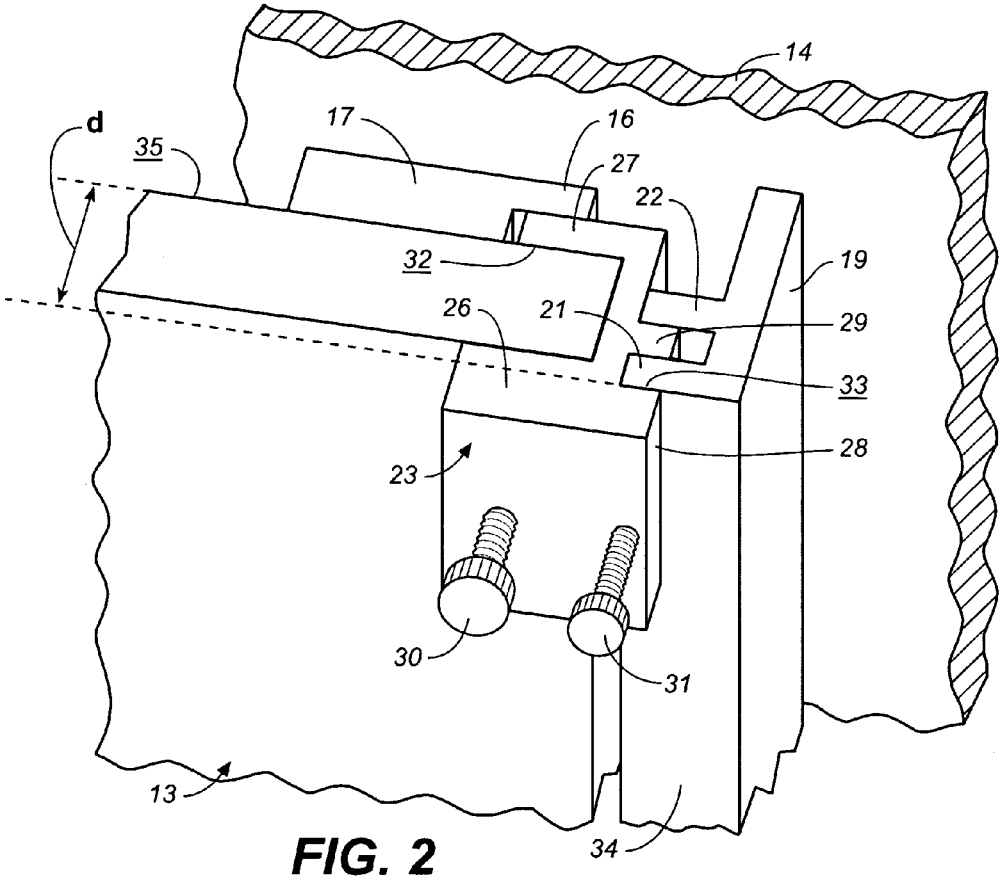
FIG. 2 is a fragmentary isometric view of one embodiment of apparatus according to the invention for scribing a trim strip to fit between a cabinet and a nearby surface.
Figure 3:
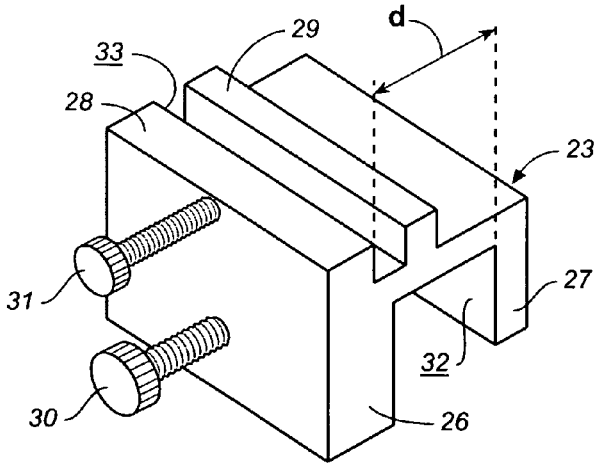
FIG. 3 is an isometric view of the scribe strip holder or clamp which is holding the trim strip in the embodiment of FIG. 2.

As illustrated in FIG. 2, the trim strip is held on the cabinet in a fixed position away from the wall or ceiling while it is being scribed or trimmed. The strip is held in that position by holding tools or clamps 23. Although only one of the holders is shown in the drawings, it will be understood that a plurality of such devices are spaced at intervals along the length of the trim strip. Thus, for example, with a cabinet having a height on the order of 36 inches, four of the holders might be positioned about 12 inches apart along the strip. One of the holders is illustrated by itself in FIG. 3.

The holder has a first pair of jaws in the form of flanges 26, 27 between which the outer wall 12 of the cabinet is received and a second pair of jaws in the form of flanges 28, 29 between which rib 21 on the back side of trim strip 11 is received. Thumbscrews 30, 31 are threadedly mounted in flanges 26, 28 and provide means for securing the holder to the cabinet wall and the trim strip to the holder so that the trim strip is held firmly in a fixed position relative to the cabinet wall while it is being scribed or trimmed. Except for the thumbscrews, each of the holders is formed as a one-piece, rigid body having contours which mate with the cabinet wall and the trim strip.

The spacing between the flanges 26, 27 is slightly greater than the thickness of the thickest cabinet wall with which the holder will be used. Thus, for example, in the United States where cabinet walls typically have a thickness on the order of ¾, ⅝ or ½ inch, the spacing between the flanges can be on the order of 13/16 inch. The spacing between flanges 28, 29 is slightly greater than the thickness or width of the rib on the trim strip so the sides of the rib fit closely with the faces of the flanges.

The inner faces 32, 33 of flanges 27, 28 serve as reference surfaces which align the trim strip so that the inner edge 34 of the trim strip which will face the cabinet is offset inwardly or laterally from the outer surface 35 of the cabinet by a predetermined distance d which corresponds to the distance between a guide and a marker or cutter in the tool used for scribing or trimming the trim strip. In that regard, it will be noted that thumbscrew 30 presses the outer surface of the cabinet wall tightly against the face 32 of flange 27 to provide an accurate reference regardless of the thickness of the cabinet wall.

Figure 4:
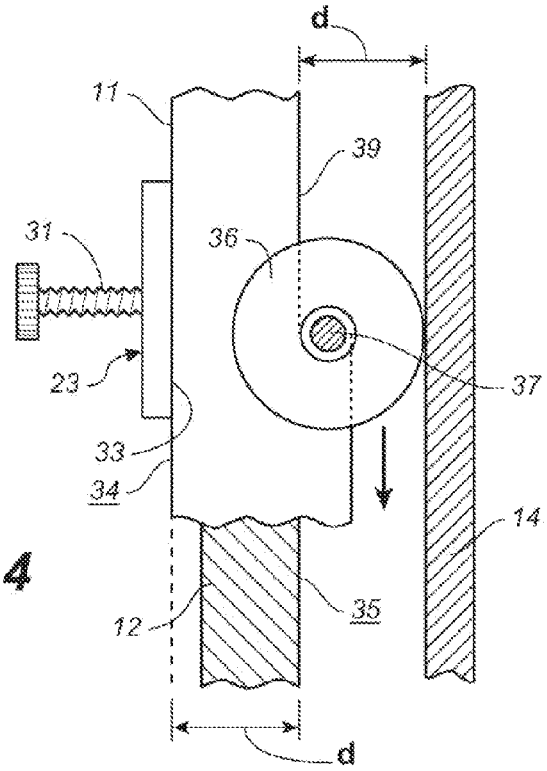
FIGS. 4 and 5 are fragmentary vertical sectional views, partly broken away of two embodiments of the invention in operation in scribing a trim strip.

In the embodiment illustrated in FIG. 4, the scribing tool is an offset router with a scribing accessory as described and illustrated in U.S. Pat. No. 5,013,196, the disclosure of which is incorporated herein. That router has a guide wheel 36 which is disposed concentrically about router bit 37 and can be brought into peripheral engagement with and run along the surface to which the trim strip is to be fitted. The diameters of the guide wheel and the router bit are such that the distance between a point on the perimeter of the guide wheel and a point on the opposite side of the router bit is the same predetermined distance d as the offset between clamp faces 32 and 33. Thus, when the guide wheel is run along the surface of the wall or ceiling and the router bit is in cutting engagement with the trim strip, the contour of the surface is transferred to the trim strip in that the strip is trimmed to have an outer edge 39 that mates with the surface of the wall or ceiling.

Operation and use of the embodiment of FIG. 4 and therein the method of the invention is as follows. After the cabinet has been hung, scribe strip holders 23 are placed on the outer wall 12 of the cabinet, with the cabinet wall firmly seated between jaws 26, 27 and thumbscrews 30 are tightened against the cabinet wall to secure the clamps in place. Trim strip 11 is placed in clamps 23 with rib 21 firmly seated between jaws 28, 29 and thumbscrews 31 are tightened against the rib to secure the trim strip in place.

With the trim strip thus clamped in position, the outer edge of it is trimmed to match the contour of the wall or ceiling by running the router along the strip with guide wheel 36 in engagement with the wall and router bit 37 cutting the strip. Since the inner edge 34 of the strip is offset inwardly from the outer surface 35 of the cabinet wall by the same distance d as the distance between the periphery of the guide wheel and the cutting edge of the router bit, the strip is cut to have the same width as the space between the surfaces of the cabinet and the wall or ceiling.

After the strip is trimmed, it is removed from the clamps, the clamps are removed from the cabinet, and the strip is pressed into position in the space between the cabinet and the wall or ceiling, with the tongue 16 on cleat 17 being received in the groove 18 on the back side of the strip. In most applications, the frictional engagement between the tongue and groove will hold the trim strip in place, but it can also be glued in place, if desired.

Figure 5:
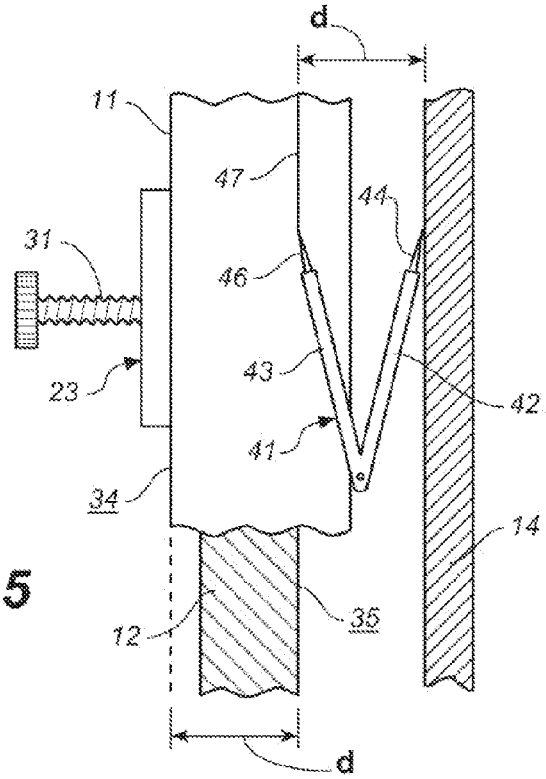

In the embodiment of FIG. 5, a conventional carpenter's scribe tool 41 is employed to transfer the contour of the wall or ceiling to the trim strip. In this embodiment, the trim strip is held in the same manner as in the embodiment of FIG. 4, but it is marked with the contour of the wall or ceiling, rather than being cut in place. The scribe has two arms 42, 43, with the tip 44 of arm 42 being run along the wall or ceiling as a guide and the tip 46 of arm 43 marking a line 47 corresponding to the contour of the wall or ceiling onto the trim strip. The tips of the two arms are spaced apart by the same distance d that the inner edge of the trim strip is offset from the outer surface of the cabinet wall when it is clamped in place.

Operation and use, and therein the method, of the embodiment of FIG. 5 is generally similar to that of FIG. 4. In the embodiment of FIG. 5, however, once the trim strip has been clamped in place, scribing tool 41 is run along the strip with the tips 44, 46 of arms 42, 43 engaging the surface of the wall or ceiling and the strip to scribe a line 47 corresponding to the contour of the surface on the strip. Thereafter, the strip is removed from the clamps and trimmed along the line to match the contour of the wall or ceiling, then installed in the manner described above.

Figure 6:
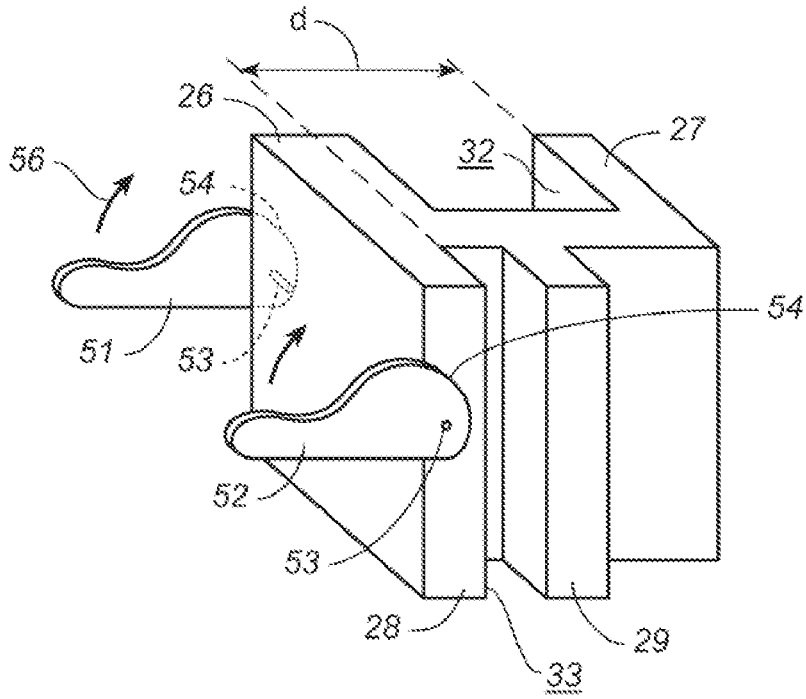
FIGS. 6 and 7 are isometric views of other embodiments of a scribe strip holder or clamp for holding trim strips in accordance with the invention.
Figure 7:
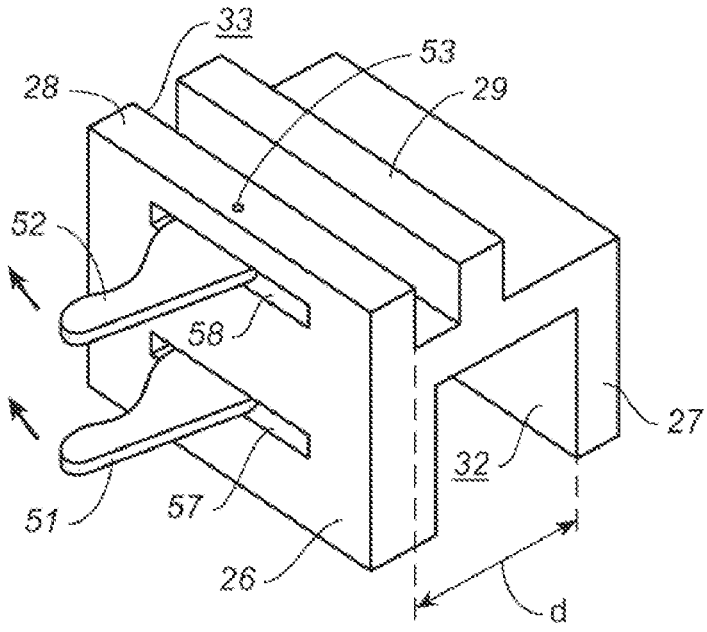

FIGS. 6 and 7 illustrate two additional embodiments of the clamp or holder which have cams rather than thumbscrews for securing the holder to the trim strip and cabinet. In the embodiment of FIG. 6, cam levers 51, 52 are pivotally mounted on the edges of flanges 26, 28 by pins 53, with camming surfaces 54 disposed eccentrically of the pins. The cam locks are shown in their open or unlocked positions, with the levers extending outwardly and the camming surfaces out of position for engagement with the trim strip and cabinet wall. The cam locks are engaged by rotating the levers in the direction of arrows 56 to bring respective ones the camming surfaces into engagement with the trim strip and the cabinet wall.

The embodiment of FIG. 7 is similar to the embodiment of FIG. 6 except that the cam levers are mounted in slots 57, 58 in flanges 26, 28, rather than on the edges of the flanges.

Operation and use of the embodiments of FIGS. 6 and 7 is similar to that of the embodiment with the thumbscrews except that the clamps are secured to the cabinet and to the trim strip with the cam locks rather than the thumbscrews.

The invention has a number of important features and advantages. It is easy to use, and provides a fast and accurate way to scribe trim strips to fit between cabinets and the surfaces of nearby walls and ceilings.

It is apparent from the foregoing that a new and improved holding tool and method for scribing a trim strip to fit between a cabinet and a nearby wall or ceiling have been provided. While only certain presently preferred embodiments have been described in detail, as will be apparent to those familiar with the art, certain changes and modifications can be made without departing from the scope of the invention as defined by the following claims.

The invention claimed is:

1. A tool mounted on a wall of a cabinet to hold a trim strip that is being scribed to fit between the wall and a nearby surface with a first edge of the trim strip facing the wall and a second edge of the trim strip facing the surface, comprising: a rigid, one-piece, generally rectangular body having a first pair of laterally spaced, elongated flanges defining a first channel of substantially greater length than width in which an edge portion of the cabinet wall is received with an outer surface of the wall in contact with a reference surface on the flange on one side of the first channel, and a second pair of laterally spaced, elongated flanges defining a second channel of substantially greater length than width in which a portion of the trim strip is received, with the edge of the trim strip that faces the cabinet in contact with a reference surface on the flange on one side of the second channel, the channels being positioned back-to-back and opening in opposite directions, with the reference surfaces being offset laterally of each other and facing in opposite directions.

2. The tool of claim 1 including a screw threadedly mounted in the flange opposite the reference surface in the first channel and bearing against the inner side of the cabinet wall, thereby securing the tool to the wall and pressing the outer surface of the cabinet wall and the reference surface together.

3. The tool of claim 1 including a cam lever pivotally mounted to the flange opposite the reference surface in the first channel and bearing against the inner side of the cabinet wall, thereby securing the tool to the wall and pressing the outer surface of the cabinet wall and the reference surface together.

4. The tool of claim 1 including a screw threadedly mounted in one of the flanges defining the second channel and bearing against the trim strip to secure the trim strip to the tool.

5. The tool of claim 1 including a cam lever pivotally mounted to one of the flanges defining the second channel and bearing against the trim strip to secure the trim strip to the tool.

6. A method of scribing a trim strip to fit between a cabinet and a nearby surface with a first edge of the trim strip facing one side of the cabinet and a second edge of the trim strip facing the surface, comprising the steps of: mounting a trim strip holding tool on a side wall of the cabinet with a groove in the tool extending in a direction generally parallel to the cabinet wall and a reference surface on one side of the groove offset laterally a predetermined distance from the outer surface of the cabinet wall, inserting a portion of the trim strip into the groove with the first edge of the trim strip aligned with the reference surface and thereby offset from the outer surface of the cabinet wall, running a guide along the nearby surface while the trim strip is held in the offset position, and engaging the trim strip with a scribing tool spaced the predetermined distance from the guide to transfer the contour of the nearby surface to the trim strip as the guide is run along the surface.

7. The method of claim 6 wherein the portion of the trim strip that is inserted into the groove is a rearwardly projecting rib that is utilized in securing the trim strip in position between the cabinet and the nearby surface.

8. The method of claim 6 including the step of pressing the first edge of the trim strip against the reference surface with a clamping screw.

9. The method of claim 6 including the step of pressing the first edge of the trim strip against the reference surface with a cam.

10. The method of claim 6 wherein a guide wheel disposed concentrically about a router bit is run along the nearby surface with the router bit engaging the trim strip and cutting it to form the second edge.

11. The method of claim 6 wherein one arm of a marking tool is run along the nearby surface with a second arm of the marking tool engaging the trim strip and marking it with a line corresponding to the contour of the surface.

* * * * *